US012781417B2

(12) United States Patent
Zhao et al.

(10) Patent No.: US 12,781,417 B2
(45) Date of Patent: Nov. 3, 2026

(54) FILTERED DETERGENT DISPENSING ASSEMBLY AND WASHING APPARATUS

(71) Applicants: QINGDAO HAIER WASHING MACHINE CO., LTD., Qingdao (CN); HAIER SMART HOME CO., LTD., Qingdao (CN)

(72) Inventors: Zhiqiang Zhao, Qingdao (CN); Sheng Xu, Qingdao (CN); Xuguang Yang, Qingdao (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 262 days.

(21) Appl. No.: 18/560,198

(22) PCT Filed: Apr. 13, 2022

(86) PCT No.: PCT/CN2022/086493
§ 371 (c)(1),
(2) Date: Nov. 10, 2023

(87) PCT Pub. No.: WO2022/237436
PCT Pub. Date: Nov. 17, 2022

(65) Prior Publication Data

US 2024/0271352 A1 Aug. 15, 2024

(30) Foreign Application Priority Data

May 10, 2021 (CN) ..... 202110505294.3

(51) Int. Cl.
*D06F 39/10* (2006.01)
*D06F 33/43* (2020.01)
(Continued)

(52) U.S. Cl.
CPC ..... *D06F 39/02* (2013.01); *D06F 33/43* (2020.02); *D06F 34/22* (2020.02); *D06F 39/083* (2013.01);
(Continued)

(58) Field of Classification Search
CPC ..... D06F 33/43; D06F 34/22; D06F 39/02; D06F 39/022; D06F 39/028;
(Continued)

(56) References Cited

U.S. PATENT DOCUMENTS 2,663,429 A * 12/1953 Bossard ..... B01D 29/66 210/112
3,896,641 A 7/1975 Worst
2020/0270795 A1 8/2020 Zarcone et al.

FOREIGN PATENT DOCUMENTS

CN 204185692 U 3/2015
CN 104499244 A 4/2015
(Continued)

OTHER PUBLICATIONS

International Search Report (PCT/ISA/210) and Written Opinion (PCT/ISA/237) with translation mailed on Jul. 11, 2022, by the China National Intellectual Property Administration as the International Searching Authority for International Application No. PCT/CN2022/086493. (14 pages).
(Continued)

*Primary Examiner* — David G Cormier
(74) *Attorney, Agent, or Firm* — Panitch Schwarze Belisario & Nadel LLP

(57) ABSTRACT

The present invention discloses a filtered detergent dispensing assembly and a washing apparatus, the filtered detergent dispensing assembly comprising a drawer and a cassette for accommodating the drawer, the drawer comprising, a detergent chamber for accommodating detergent; a filtration
(Continued)

module, provided on the drawer for filtering debris; and a self-cleaning module, which is connected to the filtration module for cleaning the filtration module. By providing a filtration module and a self-cleaning module on a drawer provided with a detergent chamber, the present invention is able to filter and circulate the washing water, integrate the detergent box and the filtration module in a single unit, and reduce the space occupied by the filtration module; and utilize the self-cleaning module to clean the filtration module, preventing the filtration module from being clogged to affect the filtration effect.

16 Claims, 4 Drawing Sheets

(51) Int. Cl.

| | |
|---|---|
| ***D06F 34/22*** | (2020.01) |
| ***D06F 39/02*** | (2006.01) |
| ***D06F 39/08*** | (2006.01) |
| *D06F 103/20* | (2020.01) |
| *D06F 103/42* | (2020.01) |

(52) U.S. Cl.
CPC ..... *D06F 39/10* (2013.01); *D06F 2103/20* (2020.02); *D06F 2103/42* (2020.02)

(58) Field of Classification Search
CPC .... D06F 39/083; D06F 39/10; D06F 2103/20; D06F 2103/42; D06F 2105/34; B01D 29/6469; B01D 29/6476; B01D 29/6484; B01D 29/6492
See application file for complete search history.

(56) References Cited

FOREIGN PATENT DOCUMENTS

| | | | | | |
|---|---|---|---|---|---|
| CN | 104947387 | A | | 9/2015 | |
| CN | 109957924 | A | | 7/2019 | |
| CN | 112376245 | A | | 2/2021 | |
| EP | 1645675 | A1 | | 4/2006 | |
| EP | 3695768 | A1 | | 8/2020 | |
| EP | 3789530 | A1 | * | 3/2021 | ..... D06F 58/22 |
| WO | WO-2019081013 | A1 | * | 5/2019 | ..... D06F 34/22 |

OTHER PUBLICATIONS

Extended European Search Report issued on Sep. 25, 2024, by the European Patent Office in corresponding EP Application No. 22806406.9 (6 pages).

* cited by examiner

FILTERED DETERGENT DISPENSING ASSEMBLY AND WASHING APPARATUS

TECHNICAL FIELD

The present invention belongs to the field of home appliances, and specifically relates to a filtered detergent dispensing assembly and a washing apparatus.

BACKGROUND

Microfibers are fiber particles less than 5 mm in length. In 2011, Browne et al. first suggested that home laundering of synthetic fiber garments is an important source of microfibers, and experimentally showed that a single washing of a garment can release more than 1,900 fibers, which drew attention to the source of microfibers released from home laundering. The IUCN (International Union for the Conservation of Nature) published a study on primary microfibers released into the global ocean in 2017. The report shows that washing synthetic fabrics can release 35% of primary microfibers into the ocean.

In 2013, the number of household washing machines in the world has reached 840 million units. With the increase in population, the global consumption of synthetic fiber textiles is gradually increasing, and the number of washing machines and the frequency of washing will also gradually increase, so it is very urgent to study how to collect the released synthetic microfibers caused by the washing process.

Chinese patent application No. CN201780096297.8 discloses a washing machine having a drum, a water collection tank below the drum, a water cycle, the water cycle comprising a withdrawable drawer for introducing detergents or additives, and the water cycle being fluidly connected to a detection device for detecting microfibers or contaminants in the water, as well as to a recirculation pump and to a tube for circulating the water. The method of operation comprises the steps of diverting a certain amount of water circulating in the circulation and delivering it to the detection device for analysis. Depending on the result of this analysis, activating a filtration process using a filtration device for filtering out microfibers from the water. The microfibers that have been filtered out can be collected and the microfibers can then be easily removed from the washing machine.

While the filtration device in the above method can be used to filter microfibers and circulate the wash water, the filtration device is not capable of self-cleaning to remove debris accumulated in the filtration device.

In view of the above technical defects, the present invention is proposed.

SUMMARY

The technical problem to be solved by the present invention is to overcome the deficiencies of the prior art and to provide a filtered detergent dispensing assembly that is capable of filtering microfibers for filtering and circulating the washing water as well as cleaning the filtration module.

In order to solve the above technical problems, the basic idea of the technical solution adopted in the present invention is:

A filtered detergent dispensing assembly comprising a drawer and a cassette for housing the drawer, the drawer comprising, a detergent chamber for holding detergent;

a filtration module, provided on the drawer for filtering debris;

a self-cleaning module, connected to the filtration module, for cleaning the filtration module.

By adopting the above-described scheme, the detergent dispensing assembly can not only realize holding detergent and adding detergent to the device to be added with detergent; it can also filter and circulate the washing water, integrating the detergent cassette and the filtration module, and reduce the occupied space of the filtration module; it can also realize cleaning the filtration module through the self-cleaning module, preventing the filtration module from being blocked and affecting the filtration effect.

Further, the filtering module comprises, a housing, provided in the drawer, forming a chamber inside;

a filtration section, provided within the housing;

a first water inlet section, provided on the housing;

a first water outlet section, provided on the housing, with the inlet end located on a different side of the filtration section from the outlet end of the first water inlet section;

a first valve body, provided on the first water outlet section, for controlling the passage of water in the first water outlet section.

Preferably, the first water inlet section and the first water outlet section are arranged on two opposite housing walls of the housing, respectively.

By adopting the above solution, the filtering section can filter the washing water entering the chamber through the first water inlet section, and the first valve body can control the opening and closing of the water path of the first water outlet section, and can choose whether to filter the washing water according to the need.

Further, the self-cleaning module comprises, a second water inlet section, provided on the housing for passing tap water into the chamber from an orientation different from that in which the water to be filtered passes through the filtration section;

a second water outlet section, provided on the housing, with the inlet end located on a different side of the filtration section from the outlet end of the second water inlet section, connected to the outlet end of the first water inlet section for discharging tap water from a side of the filtering section where the water to be filtered and into a stowage section;

a collection section, located downstream of the filtration section, is used to collect debris removed from the filtration module carried by discharged tap water;

a second valve body, provided on the second water outlet section, for controlling on and off of a water path of the second water outlet section.

Preferably, the inlet end of the second inlet section and the inlet end of the first water inlet section are located on the same side of the housing.

Preferably, the inlet end of the second water outlet section and the outlet end of the first water inlet section are located on the same side of the housing.

By adopting the above solution, the self-cleaning module can flush the filtration module, and the direction of flushing is opposite to the direction of filtering debris, and the tap water ultimately enters the second outlet section from the side where the filtered water enters the filtration section to be discharged, so as to achieve the function of cleaning the filter module. In addition, the stowage section can collect the debris after cleaning, and therefore, as long as it is regularly cleaned in the stowage section to get rid of the debris. The inlet ends of the two water inlet sections is located at the same end of the housing, which can simplify the water inlet pipeline and facilitate water inlet; the inlet end of the second water outlet section and the outlet end of the first water inlet section are located at the same side of the housing, which simplifies the path of water passage.

Further, the self-cleaning module further comprises a scraping section, provided inside the housing, subjected to forceful movement for scraping debris from at least the filtration section.

By adopting the above-described scheme, the scraping section scrapes the filter section, which prevents debris stuck inside the filter section from being easily flushed out, and thus improves the cleaning effect of the filter section.

Further, the filtering section is a hollow columnar structure with through holes in the outer wall, and the scraping section is provided in the inner cavity formed by the filtering section, in contact with the inner wall of the filtering section.

Preferably, an opening is provided at one end of the filtering section towards the first water inlet section for passing water to be filtered through the opening into the inner cavity.

Preferably, the scraping section is provided in a plurality.

Preferably, the scraping section is of a mesh plate-like structure, with each end movably resisting the inner wall of the filtering section.

By adopting the above-described scheme, the hollow columnar structure with through holes on the outer wall can increase the area of the filtering section, and the water to be washed can be filtered from one end of the filtering section by completely passing into the inner cavity of the filtering section, thus ensuring the effect of filtration; since most of the debris accumulates in the inner cavity after filtration, setting a plurality of scraping sections in the inner cavity can improve the scraping efficiency.

Further, a gap is provided between at least one side of the peripheral wall of the filtration section and/or the end of the filtration section away from the first water inlet section and the inner wall of the housing, and the outlet end of the second water outlet section is provided in the gap.

Preferably, the outlet end of the second water outlet section is provided on a side close to the inlet side of the water to be filtered in the filtration section.

By adopting the above solution, the tap water can pass through the filtration section from a plurality of places outside the filtration section, and the filtration section is backwashed to ensure the cleaning effect; the outlet end of the second water outlet section is set on the side close to the inlet end of the water to be filtered in the filtration section to increase the flow path of the tap water, and then increase the contact rinsing area with the filtration section, and increase the rinsing and cleaning effect.

Further, the filtering section comprises, a filtration body for filtering debris;

a limiting unit, having a perforated structure, is provided on the filtration body for hindering the deformation of the filtration body under force.

Preferably, the filtration body is made of ultrafiltration and/or nanofiltration membranes and/or graphene material.

Preferably, the limit unit comprises, a first fixing frame, provided on a side of the filtering body facing the first inlet section, may be fixedly connected to the inner wall of the housing and the filtering section;

a second fixing frame, provided on a side of the filtration body away from the first fixing frame, the scraping section being fixedly connected to the second fixing frame.

By adopting the above scheme, the limiting unit can prevent the filtration body from being deformed under the action of water pressure, resulting in the filter holes becoming larger, unable to filter the fine microfibers, and reducing the filtration effect, and can also play a filtering role, not hindering the filtration of sundries. The ultrafiltration membranes, nanofiltration membranes, graphene materials, and other materials have a microporous structure, which can filter microfibers and other small sundries, and achieve the effect of filtering and collecting microfibers. In addition, the fixed frame structure of the restriction unit makes the restriction unit, in addition to having the function of restricting the filtering body to prevent deformation, also play the role of fixing and connecting the shell and the filtering part, as well as installing the scraping part.

Further, the housing is also provided with a pressure detecting device, provided close to the filtration section, for detecting water pressure.

By adopting the above-described scheme, the pressure detecting device can detect the water pressure close to the part of the filtering section, and when the water pressure is detected to be higher than a set value, it can be assumed that excessive debris has accumulated in the filtering section or that the pore structure on the filtering section has been clogged, and needs to be cleaned.

Another object of the present invention is to provide a washing apparatus fitted with a filtered detergent dispensing assembly as described above.

Further, the washing apparatus comprises, an outer drum;

a drainage assembly, in communication with the outer drum, for draining water from the outer drum to the exterior of the machine or into the filtered detergent dispensing assembly;

an inlet pipe, connecting the cassette to an outer drum, for passing liquid from the detergent dispensing assembly into the outer drum;

a judgment module for determining, at least based on the detected water pressure, whether the filtration module is clogged;

a control module for controlling the state of the drainage assembly and the operating state of the filtration module and self-cleaning module, at least in accordance with the washing program and the clogging condition of the filtration module as determined by the judgment module.

Preferably, the drainage assembly comprises, a first drain pipe, connected to the outer drum, for discharging water from the outer drum to outside;

a three-way valve, the inlet end of which is connected to the first drain pipe;

a second drain pipe, connected to one outlet end of the three-way valve, is used to discharge water from the first drain pipe out of the washing apparatus;

a circulation water pipe, the inlet end connected to the other outlet end of a three-way valve, and the outlet end matched removably connected to the first inlet section for filtering and recirculating water from the first drain pipe into the detergent dispensing assembly;

the control module may control the opening and closing state of the three-way valve.

By adopting the above scheme, it is possible to choose to control the water discharged from the outer drum to be filtered through the detergent delivery assembly and then passed into the outer drum according to the actual situation, so as to achieve the function of circulating the washing water as well as preventing the microfibers from ultimately entering the soil and causing harm to the environment; or to choose to discharge directly, so as to make full use of the function of the detergent cassette's water intake and to reduce the space occupied by the filtration module.

After adopting the above technical solution, the present invention has the following beneficial effects compared with the prior art.

1. The detergent dispensing assembly can not only realize holding the detergent and adding detergent to the device to be added; it can also filter and circulate the washing water, integrating the detergent box and the filtration module, and reducing the occupied space of the filtration module; it can also realize cleaning the filtration module through the self-cleaning module, preventing the filtration module from being blocked and affecting the filtration effect.
2. The filtration module and self-cleaning module have a valve body respectively, can be controlled to realize the filtration function and self-cleaning function; filtered water through the filtration part of the direction and tap water through the filtration part of the direction of the opposite direction, it is convenient to attached to the filtering part of the sundries on the rinsing and carried by the tap water to get rid of the filtration part. The stowage part of the collection of sundries after the cleaning, so as long as the stowage part of the cleaning of the sundries can be taken off regularly. The two inlet ends of the water inlet sections are located at the same end of the housing, which can simplify the water inlet pipeline and facilitate the water inlet; the inlet end of the second water outlet section is located on the same side of the housing as the outlet end of the first water inlet section, which simplifies the path of the water.
3. The scraping part can scrape the debris which is not easy to be washed out and make the debris out of the filtering part, so as to improve the cleaning effect of the filtering part.
4. The hollow columnar structure with through holes in the outer wall can increase the area of the filtration section, and the water to be washed can be filtered from one end of the filtration section into the inner cavity of the filtration section completely, which can ensure the effect of filtration; as most of the debris accumulates in the inner cavity after filtration, a plurality of scraping sections are set in the inner cavity, which can improve the scraping efficiency.
5. The filtration part of the non-to be filtered water through the end and the shell has a gap between the tap water to facilitate the filtration part of the reverse flushing, to ensure the cleaning effect; limiting unit not only to prevent the filtering body under the action of water pressure deformation of force, resulting in the filter pore becomes large, cannot filter the fine microfibers, filtration effect is reduced, but also play a role in the filtration, does not impede the filtration of debris. The ultrafiltration membrane, nanofiltration membrane, graphene material and other materials have a microporous structure, can filter microfibers and other tiny debris to achieve the effect of filtering and collecting microfibers. ultrafiltration membrane, nanofiltration membrane, graphene material and other materials have a microporous structure, which can filter microfibers and other tiny debris to achieve the effect of filtering and collecting microfibers.
6. The pressure detection device can detect the water pressure near the filtration part, when the detected water pressure is higher than the set value, it can be considered that the filtration part of the excessive accumulation of debris or filtering part of the pore structure is clogged, need to be cleaned up. The control module can be based on the relevant procedures and detection data to select the control of the three-way valve opening and closing conditions and the two inlet part of the two outlet part of the water condition, and then control the water discharged from the outer drum to be filtered and then pass into the outer drum and to clean the filtration module, or discharge directly.

Specific embodiments of the present invention are described in further detail below in connection with the accompanying drawings.

BRIEF DESCRIPTION OF THE DRAWINGS

The accompanying drawings are used as part of the present invention to provide a further understanding of the invention, and the schematic embodiments of the invention and their illustrations are used to explain the invention but do not constitute an undue limitation of the invention. Obviously, the accompanying drawings in the following description are only some of the embodiments, and other accompanying drawings may be obtained on the basis of these drawings for a person of ordinary skill in the art without creative work. In the accompanying drawings.

Figure 1:
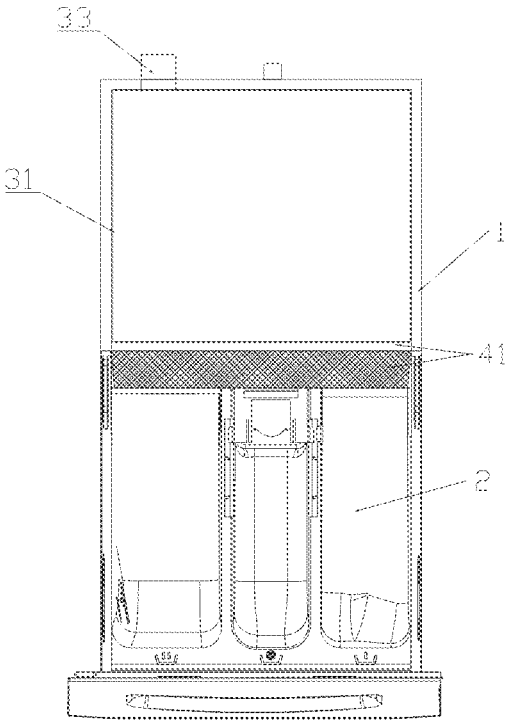
FIG. 1 is a schematic diagram of the structure of the drawer of the present invention.

In the figure; 1, drawer; 2, detergent chamber; 3, filtration module; 31, housing; 311, mesh mounting plate; 32, filtration section; 321, filtration body; 322, limiting unit; 3221, first fixing frame; 3222, second fixing frame; 3223, third fixing frame; 33, first water inlet section; 34, first water outlet section; 35, first valve body; 36, filtered water inlet chamber; 4, self-cleaning module; 41, stowage section; 42, scraping section; 43, second water inlet section; 431, second water inlet connector; 432, water inlet passage; 44, second water outlet section; 441, second water outlet; 442, water outlet passage; 45, second valve body; 5, connecting member; 6, pressure detecting device; 7, outer drum; 8, drainage assembly; 81, first drain pipe; 82, second drain pipe; 83, circulation water pipe; 84, three-way valve; 85, drainage pump; 10, inlet pipe; 11, cassette.

It is to be noted that these accompanying drawings and textual descriptions are not intended to limit in any way the scope of the present invention as conceived, but rather to illustrate the concepts of the invention for those skilled in the art by reference to particular embodiments.

DETAILED DESCRIPTION

In order to make the objects, technical solutions and advantages of the embodiments of the present invention clearer, the technical solutions in the embodiments will be described clearly and completely in the following in conjunction with the accompanying drawings in the embodiments of the present invention. The following embodiments are used to illustrate the present invention but are not used to limit the scope of the present invention.

In the description of the present invention, it is to be noted that the terms "upper", "inner", "outer", etc. indicate an orientation or positional relationship based on that shown in the accompanying drawings, and are intended solely for the purpose of facilitating the description of the present invention and simplifying the description, and are not indicative of or suggestive of the need for the referred device or element to have a particular orientation, be constructed and operated in a particular orientation, and therefore are not to be construed as a limitation of the present invention.

In the description of the present invention, it is to be noted that, unless otherwise expressly specified and limited, the terms "connected", "connected" are to be understood in a broad sense, e.g., either fixedly connected, detachably connected, or integrally connected; mechanically connected, or electrically connected; directly connected, or indirectly connected through an intermediary medium. It may be a mechanical connection or an electrical connection; it may be a direct connection or an indirect connection through an intermediate medium. For a person of ordinary skill in the art, the specific meaning of the above terms in the context of the present invention may be understood in specific cases.

As shown in FIGS. 1 to 6, a filtered detergent dispensing assembly of the invention comprises a drawer 1 and a cassette 11 for holding the drawer 1, the drawer 1 comprises a detergent chamber 2 for holding detergent, a filtering module 3, disposed on the drawer 1 for filtering debris, and a self-cleaning module 4, in connection with the filtering module 3, for cleaning the filtering module 3.

Figure 6:
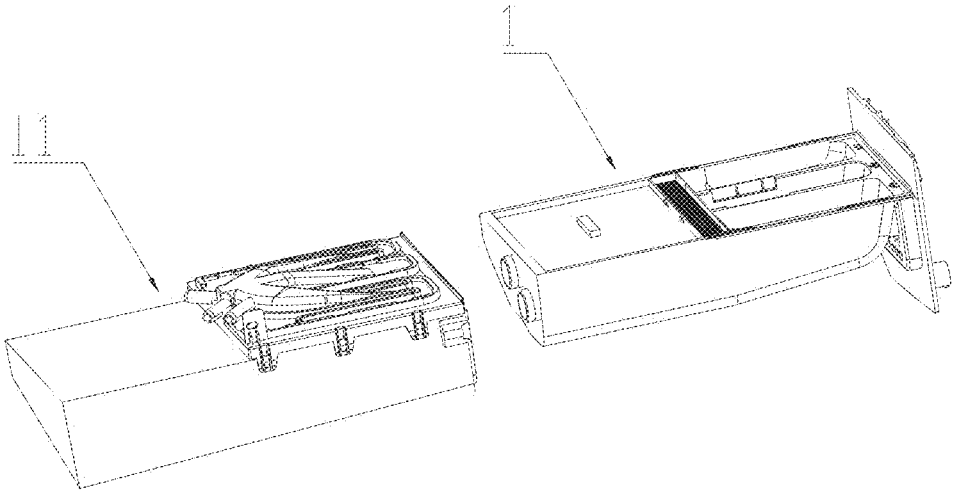
FIG. 6 is a schematic diagram of the structure of the filtered detergent dispensing assembly of the present invention.

As shown in FIGS. 1 and 6, the detergent chamber 2 is provided at the end of the drawer 1 near the drawer fastener, and the filtration module 3 and self-cleaning module 4 are provided at the other end of the drawer 1. The cassette 11 is provided with a tap water inlet pipe and a valve for controlling the passage of water from the tap water inlet pipe to the drawer 1. The drawer 1 is provided with a water inlet connecting the tap water inlet pipe and the detergent chamber 2 for passing water into the detergent chamber 2 and for mixing the water with the detergent in the detergent chamber 2 and then discharging it from the outlet on the drawer 1.

The detergent dispensing assembly of the present invention can realize both holding detergent and adding detergent to the device to be added; it can also integrate the detergent cassette with the filtration module 3 to realize filtering and circulating the washing water through the cassette assembly and reducing the occupied space of the filtration module 3; and it can also realize cleaning the filtration module 3 through the self-cleaning module 4, preventing the filtration module 3 from being clogged to affect the filtration effect.

Figure 2:
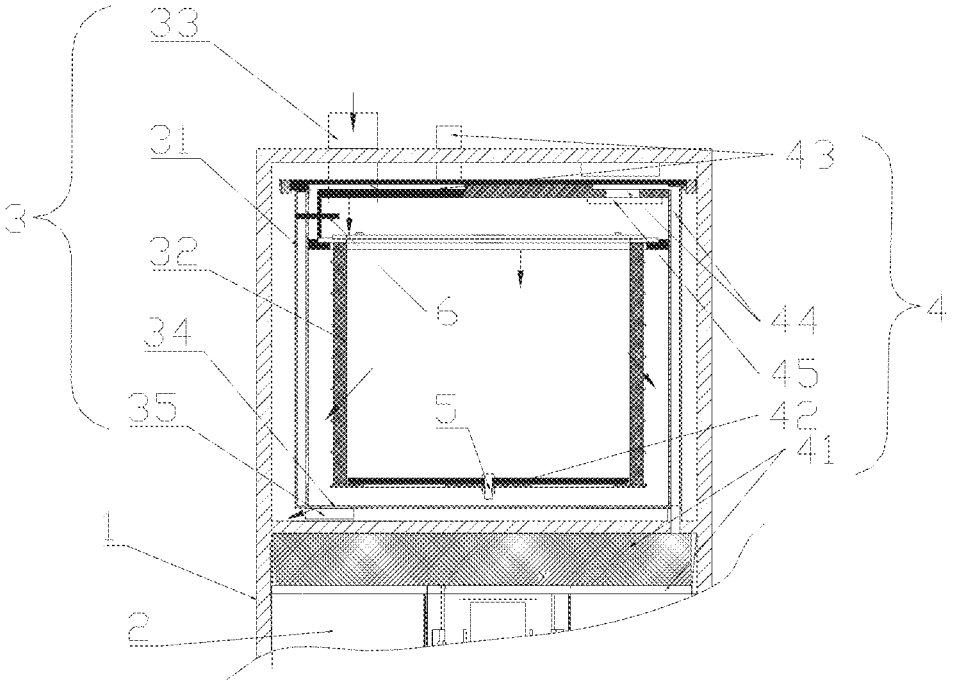
FIG. 2 is a schematic diagram of the local structure of the drawer of the present invention in the state of passing water to be filtered.

As shown in FIG. 2, the filtration module 3 comprises a housing 31, provided in the drawer 1 and forming a chamber therein; a filtration section 32, provided in the housing 31 for filtering water to be filtered into the chamber; a first water inlet section 33, provided on the housing 31 for feeding water to be filtered into the chamber; a first outlet section 34, provided on the housing 31 with the inlet end of the first outlet section 34 on a different side from the outlet end of the first water inlet section 33 for discharging filtered water; a first valve body 35, provided on the first outlet section 34 for controlling the passage of water from the first outlet section 34 sectionsectionsection.

As an embodiment, the first water inlet section 33 comprises a first water inlet connector running through the housing 31, preferably the first water inlet connector running through the wall on the side of the drawer 1 for connection with the device to be fitted with this detergent dispensing assembly, and water is input from the first water inlet connector into the housing 31. The first water outlet section 34 is an outlet running through the housing 31, the outlet being connected to the drawer 1, where the filtered water is discharged into the drawer 1 and discharged through an outlet on the drawer 1, where the outlet on the drawer 1 for discharging the detergent and the outlet on the drawer 1 for discharging the filtered water are one and the same outlet or different outlets, or where the first water outlet section 34 is a pipe running through the housing 31 and the drawer 1 at each end, where the filtered water is directly discharged through the pipe.

The filtration section 32 is mounted on the inner wall of the housing 31, the first water inlet section 33 is located on one side of the filtration section 32, and the first water outlet section 34 is located on a different side of the filtration section 32 from the first water inlet section 33. As a preferred embodiment, as shown in FIG. 2, the first water inlet section 33 and the first water outlet section 34 are disposed on two opposing shell walls of the housing 31, respectively. Preferably, the filtering section 32 is detachably connected to the inner wall of the housing 31.

The filtration section 32 of the present invention is capable of filtering the washing water entering the chamber through the first water inlet section 33, and the first valve body 35 is capable of controlling the opening and closing of the water path of the first water outlet section 34, and can choose whether to filter the washing water or not according to the need.

Figure 3:
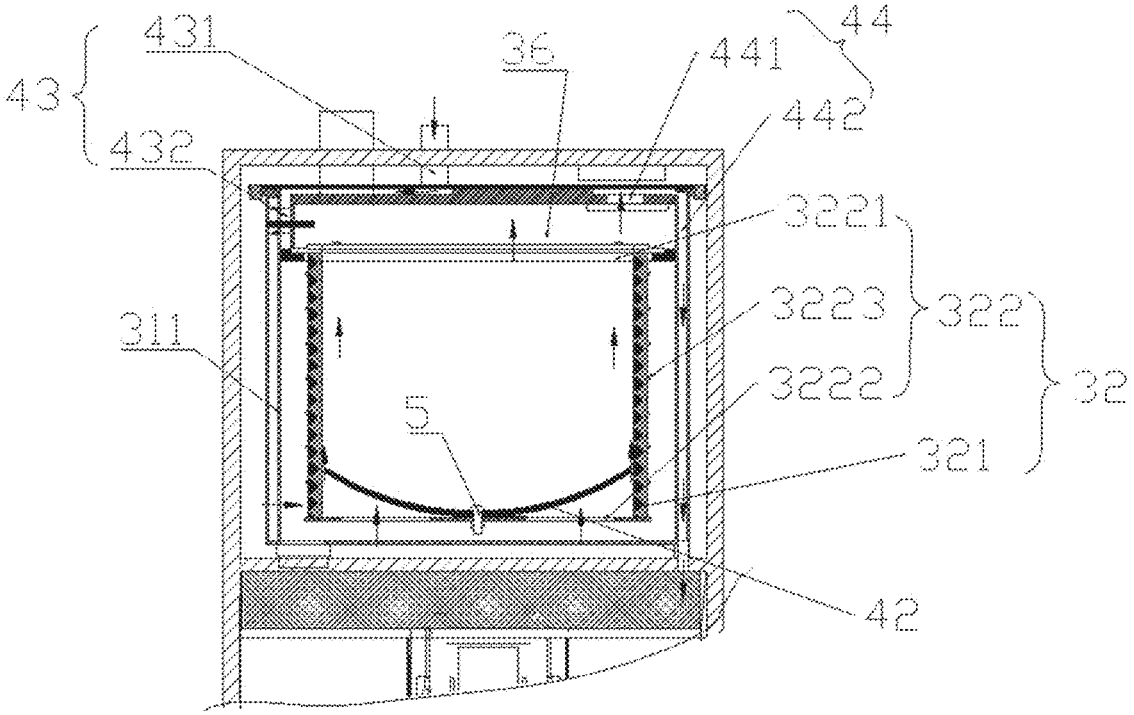
FIG. 3 is a schematic view of the structure of FIG. 2 in the state of being passed into tap water.

As shown in FIGS. 2 and 3, the self-cleaning module 4 comprises, a second inlet section 43, provided on the housing 31 for passing tap water into the chamber from an orientation different from that of the water to be filtered through the filtration section 32; a second water outlet section 44, provided on the housing 31, with an inlet end located on a different side of the filtration section 32 from the outlet end of the second inlet section 43 and communicating with the outlet end of the first water inlet section 33 connected to the outlet end of the first water inlet section 33, for discharging tap water from the side of the filtration section 32 leading to the water to be filtered and leading to a stowage section 41; a stowage section 41, disposed downstream of the filtration section 32, for collecting debris carried on the discharged tap water removed from the filtration module 3; a second valve body 45, disposed on the second water outlet section 44, for controlling the passage of water in the water pathway of the second water outlet section 44.

As shown in FIG. 2, the stowage section 41 comprises a storage unit for filtering tap water discharged from the second water outlet section 44; a storage cavity, provided in the drawer 1, formed by a partition provided in the drawer 1 and an inner wall of the drawer 1 for holding the storage unit; and preferably, the storage unit is detachably provided in the storage cavity.

The storage unit may be a mesh storage bag or storage box provided with micro perforations. The outlet end of the second water outlet section 44 is connected to the storage cavity, is located in the storage cavity or is articulated with an inlet of the storage cavity. The tap water passing through the stowage section 41 flows out of an outlet on the drawer 1, the outlet on the drawer 1 for discharging the tap water of the stowage section 41 being the same outlet as the outlet for discharging the detergent and/or the filtered water, or being a different outlet; or the tap water passing through the stowage section 41 flows out of a pipe running through the drawer 1.

The outlet end of the stowage section 41 and/or outlet end of the first outlet section 34 is connected to the inlet of the detergent chamber 2, and the stowage section 41 and/or first outlet section 34 drains through the detergent chamber 2 to the outside of the drawer 1; alternatively, the outlet end of the stowage section 41, the outlet end of the first outlet section 34, and the inlet of the detergent chamber 2 are each independent.

Further, as shown in FIGS. 2 and 3, the inlet end of the second water inlet section 43 is located on the same side of the housing 31 as the inlet end of the first water inlet section 33, and preferably, the inlet end of the second water inlet section 43 and the inlet end of the first water inlet section 33 are provided in a shell wall on the side of the housing 31 away from the detergent chamber 2.

As shown in FIGS. 2 and 3, the second water inlet section 43 comprises, a second water inlet connector 431, running through one side of the shell wall of the housing 31; an water inlet passage 432, connected to the outlet end of the second water inlet connector 431, with the outlet end of the water inlet passage 432 extending to the side of the filtration section 32 that avoids water to be washed being passed through into the filtration section 32, and, preferably, the second water inlet connector 431 running through the box wall of one side of the drawer 1 for connection to the equipment in which this detergent dispensing assembly is to be installed.

As an embodiment, as shown in FIGS. 2 and 3, the second water inlet connector 431 is provided close to the first water inlet section 33, and the water inlet passage 432 extends from the side of the first water inlet section 33 where it is connected with the second water inlet connector 431 to the side wall close to the side of the housing 31 provided with the second water inlet connector 431, and thereafter extends along the side wall to the side of the water to be filtered bypassing the filtering section 32. The first water inlet connector on the first water inlet section 33 runs through the water inlet passage 432 in a radial direction along the water inlet passage 432 located on the same side as the first water inlet section 33. There is a gap between the outlet end of the first water inlet connector and the filtration section 32, the gap cooperates with the inner wall of the housing 31 and with the outer wall of the water inlet passage 432 on the side facing the first water inlet section 33 to form an inlet chamber for water to be filtered. The water inlet chamber of water to be filtered is communicated to one side of the filtering section 32 so that the water to be filtered passes completely through the filtering section 32 from one side of the filtering section 32. The water inlet passage 432 bypasses the side of the filtering section 32 through which the water to be filtered passes and input tap water to the filtering section 32 from the side of the housing 31 near the detergent chamber 2, and the water inlet chamber of the water to be filtered is communicated to the inlet end of the second water outlet section 44.

As a preferred embodiment of the foregoing, the inlet end of the second water outlet section 44 is located on the same side wall of the housing 31 as the outlet end of the first water inlet section 33, away from the end of the outlet end of the first water inlet section 33, and the inlet end of the second inlet section 43 is located between the outlet end of the first water inlet section 33 and the inlet end of the second water outlet section 44.

As shown in FIGS. 2 and 3, the inlet end of the filtration section 32 is connected to the inner wall of the housing 31 and to the outer wall of the water inlet passage 432. The outer wall of the water inlet passage 432 is connected to the side of the inlet end of the filtration section 32 facing the inlet end of the first water inlet section 33.

As shown in FIGS. 2 and 3, a mesh mounting plate 311 is provided on the side wall of the housing 31 provided with the outlet end of the second water inlet section 43, with a gap between the mesh mounting plate 311 and the interior of the housing 31 on that side, with the outlet end of the second water inlet section 43 being connected to the gap. The edge of the inlet end of the filtration section 32 is connected to the mesh mounting plate 311 and the inner wall of the housing 31, respectively.

The second water outlet section 44 comprises a second water outlet 441, provided on a shell wall of the housing 31 on the same side as the first water inlet section 33, in connection with the first water inlet section 33, the second valve body 45 being provided on the second water outlet 441; and an water outlet passage 442, provided against an outer wall of the housing 31 on the side opposite to the outlet end of the second water inlet section 43, extending to the stowage section 41, connecting the second water outlet 441 and the stowage section 41. The second water outlet 441 is communicated to the filtered water inlet chamber 36, the filtered water inlet chamber 36 forming a chamber for draining tap water after cleaning of the filtration module 3.

The water inlet passage 432 and the water outlet passage 442 are formed by pipes provided on the housing 31 or by a sandwich of the housing 31 partially provided with a double shell wall.

As an embodiment, the stowage section 41 is provided between the housing 31 and the detergent chamber 2, as shown in FIGS. 2 and 3.

The self-cleaning module 4 of the present invention can rinse the filtration module 3, and the rinsing direction is opposite to the direction of filtering debris, so as to achieve the function of cleaning the filtration module 3. In addition, the stowage section 41 can collect the debris after cleaning, so as long as it is regularly cleaned on the stowage section 41 to take off the debris; the inlet end of the two inlet sections is located on the same side of the housing 31, which can simplify the inlet water pipeline, and make it easy to enter the water.

The self-cleaning module 4 further comprises a scraping section 42, provided inside the housing 31 and subjected to forceful movement for scraping debris from at least the filter section 32.

Further, the scraping section 42 is provided on the filtering section 32, the scraping section 42 is partially fixed to the filtering section 32, and is subjected to a forceful movement at least partially in contact with the filtering section 32 to scrape debris from the filtering section 32.

As an embodiment, the scraping section 42 is provided on the side of the filtration section 32 where the water to be filtered is passed through.

The scraping section 42 of the present invention scrapes the filter section 32, which prevents debris stuck in the filter section 32 from being easily flushed out, which in turn improves the cleaning effect of the filter section 32.

As shown in FIGS. 2 and 3, the filtering section 32 is a hollow cylindrical structure with through holes in the outer wall, and the scraping section 42 is provided in the inner cavity formed by the filtering section 32, in contact with the inner wall of the filtering section 32. The filtering section 32 is provided close to the inlet end of the first water inlet section 33.

The scraping section 42 is provided on the inner wall of the filtering section 32 away from the end which the water to be filtered, and is fixedly connected to the filtering section 32.

As an embodiment, the scraping section 42 is a mesh plate structure, the middle part of the scraping section 42 is fixedly connected with the middle part of the inner wall of one end of the filtering section 32, and is set close to the inner wall of the filtering section 32, and the two ends of the scraping section 42 are respectively connected with the inner walls of the filtering section 32 on the two sides close to the side which is fixedly connected with the scraping section 42. The scraping section 42 has a deformable shape, and after being deformed by force, the two ends move relative to the filtering section 32 to scrape debris.

The scraping section 42 may be fixedly connected to the filter section 32 by means of a connection 5 such as a screw.

Alternatively, the shape of the scraping section 42 matches the shape of the inner peripheral wall of the filtering section 32, with the outer periphery of the scraping section 42 being movably pressed against the inner peripheral wall of the filtering section 32.

Figure 4:
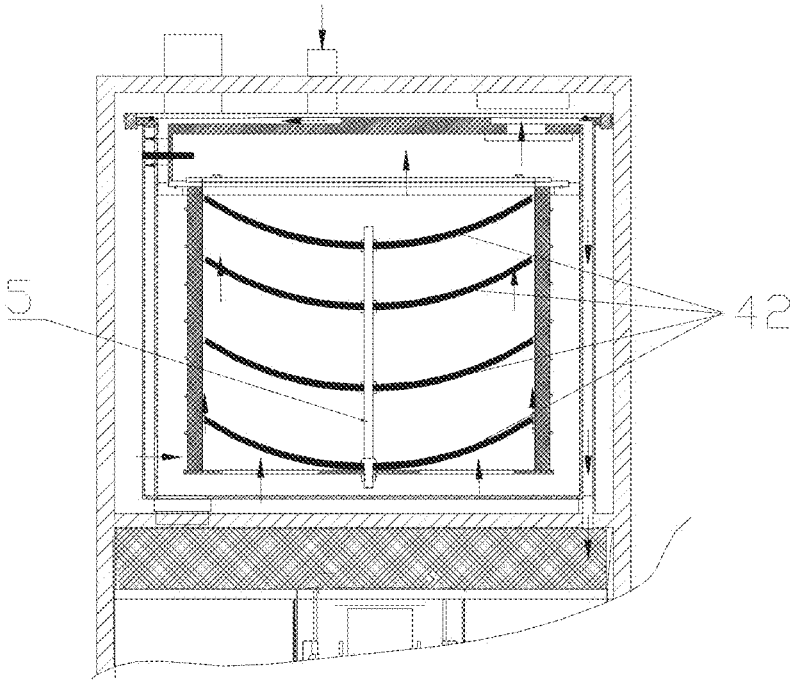
FIG. 4 is a schematic diagram of the structure of a drawer of an embodiment of the present invention.

Further, as shown in FIG. 4, the scraping sections 42 are provided in a plurality, spaced evenly along the central axis direction of the filtering section 32. The connecting member 5 is a connecting rod, one end of the connecting rod is fixedly connected to one end of the filtration section 32 away from the end of the water to be filtered, and the scraping sections 42 near the connecting rod at the end of the connecting end of the filtration section 32 are disposed close to the end wall of the filtration section 32. Each scraping section 42 passes through the connecting rod and is fixedly connected to the connecting rod. This embodiment can increase the contact area between the scraping section 42 and the filtering section 32, facilitate scraping of debris on the filtering section 32, and improve the cleaning efficiency of the filtering section 32.

Figure 5:
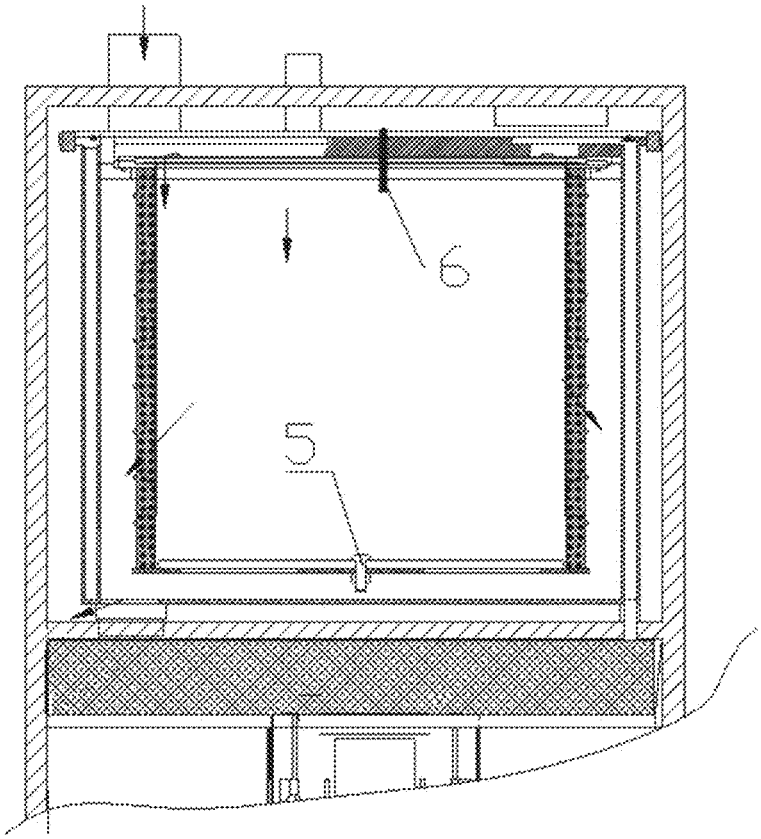
FIG. 5 is a schematic diagram of the structure of a drawer of another embodiment of the present invention.

As an embodiment, an opening is provided at one end of the filtering section 32 towards the first water inlet section 33 for passing water to be filtered through the opening into the inner chamber, the side of the filtering section 32 in this embodiment which passes into the water to be filtered may also be infinitely close to the side provided with the first water inlet section 33, as shown in FIG. 5.

The hollow columnar structure of the filtration section 32 of the present invention with through holes on the outer wall can increase the area of contact with debris, and the water using in washing can be filtered from one side of the filtration section 32 into the inner cavity of the filtration section 32 completely, thus ensuring the effect of filtration. Since most of the debris accumulates in the inner cavity after filtration, setting a plurality of scraping sections 42 in the inner cavity improves the scraping efficiency.

A gap is set between at least one side of the peripheral wall of the filtration section 32 and/or the end of the filtration section 32 away from the first water inlet section 33 and the inner wall of the housing 31, and the outlet end of the second water outlet section 44 is provided in the gap for passing tap water into the inner cavity for rinsing and cleaning of the filtration section 32.

As an embodiment, as shown in FIGS. 2 to 5, a gap is left between the peripheral wall of the filtration section 32 and the end of the filtration section 32 away from the first water inlet section 33 and the inner wall of the housing 31, forming an annular cavity, and the outlet end of the second water outlet section 44 is set on a side close to the side of the water to be filtered inlet side of the filtration section 32, so that water is flushed from the peripheral wall of the filtration section 32 and the end wall of one end of the filtration section 32 away from the first water inlet section 33 into the inner cavity through the annular cavity, and various parts of the filter section 32 are flushed and cleaned.

Further, as shown in FIG. 3, the filtration section 32 comprises, a filtration body 321 for filtering debris, and a limiting unit 322, having a perforated structure, provided on the filtration body 321 for hindering the deformation of the filtration body 321 under force and limiting the change of the filter holes on the filtration body 321. The limiting unit 322 is provided against the filtration body 321.

As an embodiment, the filtration body 321 is made of materials such as ultrafiltration membranes and/or nanofiltration membranes and/or graphene, or the filtration body 321 is a filter mesh and/or filter plate structure with micropores, etc., which can be used for filtering microfibers and other tiny debris.

The limiting unit 322 is provided on one side of the filtration body 321 or wrapped around the outer periphery of the filtration body 321, limiting the deformation of the filtration body 321 and preventing the filter holes on the filtration body 321 from becoming larger.

The limiting unit 322 of the present invention prevents the filtration body 321 from being deformed by force under the action of water pressure, which results in the filter holes becoming larger, preventing filtration of fine microfibers and reducing the filtration effect.

As shown in FIG. 3, the limiting unit 322 comprises, a first fixing frame 3221, provided at one end of the filtration body 321 towards the first water inlet section 33, which can be fixedly connected to the inner wall of the housing 31 and the filter section 32; a second fixing frame 3222, provided at one end of the filtration body 321 away from the first fixing frame 3221, with the scraping section 42 being fixedly connected to the second fixing frame 3222; a third fixing frame 3223, provided on a peripheral wall of the filtering section 32.

As shown in FIG. 3, the first fixing frame 3221 is a plate-like structure having perforations covering or encompassing an end of the filtration body 321 facing the first water inlet section 33, a gap being left between an outer peripheral wall of the filtration body 321 and the inner wall of the housing 31 as well as the mesh mounting plate 311, and an outer peripheral end of the first fixing frame 3221 extending peripherally to the inner wall of the housing 31 and the mesh mounting plate 311, fixedly connected to the inner wall of the housing 31 and to the mesh mounting plate 311, the first fixing frame 3221 not having perforations on the extended section of the first fixing frame 3221. The outer wall of the outlet end of the second inlet section 43 is sealingly connected to the side of the extension section facing the inlet end of the first water inlet section 33, and the outlet end of the second inlet section 43 is located on the outer side of the peripheral wall of the filtration section 32.

Alternatively, the filtration body 321 is provided with an opening at the end of the filtration body 321 that passes through the water to be filtered, then the first fixing frame 3221 may also be located at the periphery of the opening to form the extension that does not have a perforation.

The second fixing frame 3222 is a plate-like structure having perforations covering or encompassing one end of the filtering body 321 opposite the first fixing frame 3221, and the connecting member 5 penetrates through both sides of the second fixing frame 3222 and filtering body 321 to be fixedly connected to filtering section 32.

The third fixing frame 3223 is of coil spring construction, socketed to the inner and outer circumferential walls of the filtration body 321.

The limiting unit 322 of the present invention, in addition to having the function of limiting the filtering body against deformation, also serves to securely connect the housing 31 and the filtering section 32, as well as to mount the scraping section 42.

As shown in FIGS. 2 and 5, the housing 31 is further provided with a pressure detecting device 6, provided close to the filtering section 32, for detecting the water pressure. The pressure detecting device 6 is provided on the filtration section 32 and/or on the inner wall of the housing 31 and/or on the second water inlet section 43.

The pressure detecting device 6 of the present invention detects the water pressure close to the part of the filtering section 32, and when the water pressure is detected to be higher than a set value, it can be assumed that excessive debris has accumulated in the filtering section 32 and needs to be cleaned.

Working principle: as shown in FIG. 2, when the need for filtration, the first valve body 35 is in the open state, the second valve body 45 is in the closed state, the water to be filtered is input from the first water inlet section 33 into the housing 31, the water to be filtered through the filtered water inlet chamber 36 between the filtration section 32 and the first water inlet section 33 into the side of the filtration section 32, being filtered through the filtering of the body 321 and the first fixing frame 3221 into the inner chamber of the filtering section 32, filtered through the peripheral wall of the filtering section 32 or the side wall opposite to the side of the filtering section 32 in which the water to be filtered is fed, and then flowed out into the annular chamber formed between the filtering section 32 and the housing 31, and ultimately discharged from the first water outlet section 34 to the outside of the housing 31. Under the action of the water flow; the scraping section 42 is affixed to the inner wall of the filtering section 32, and serves to fix the filtering body 321 to hinder the filtering deformation of the filtering body 321 as well as to filter.

As shown in FIG. 3, when the pressure detection device 6 detects that the pressure is greater than a set value, it is considered that a large amount of debris is attached to the filtration section 32 or that it has been clogged, and the filtration module 3 needs to be cleaned. At this time, the first valve body 35 is closed and the second valve body 45 is opened, and tap water is passed from the second water inlet section 43 into the annular cavity, and the water flow enters the inner cavity of the filtration section 32 through the annular cavity from the periphery of the filtration section 32 and the exterior of one end away from the filtered water inlet chamber 36, under the action of water pressure, the scraping section 42 is deformed by the force, and both ends of the movement along the direction of the water flow to scrape the sundries on the inner wall of the filtering section 32, and the tap water with sundries is ultimately discharged from the second water outlet section 44 connected to the filtered water inlet chamber to reverse rinse the filtering section 32, and the rinsed tap water is discharged into the stowage section 41, and is finally discharged out of the drawer 1 being filtered by the filtering section 41.

Figure 7:
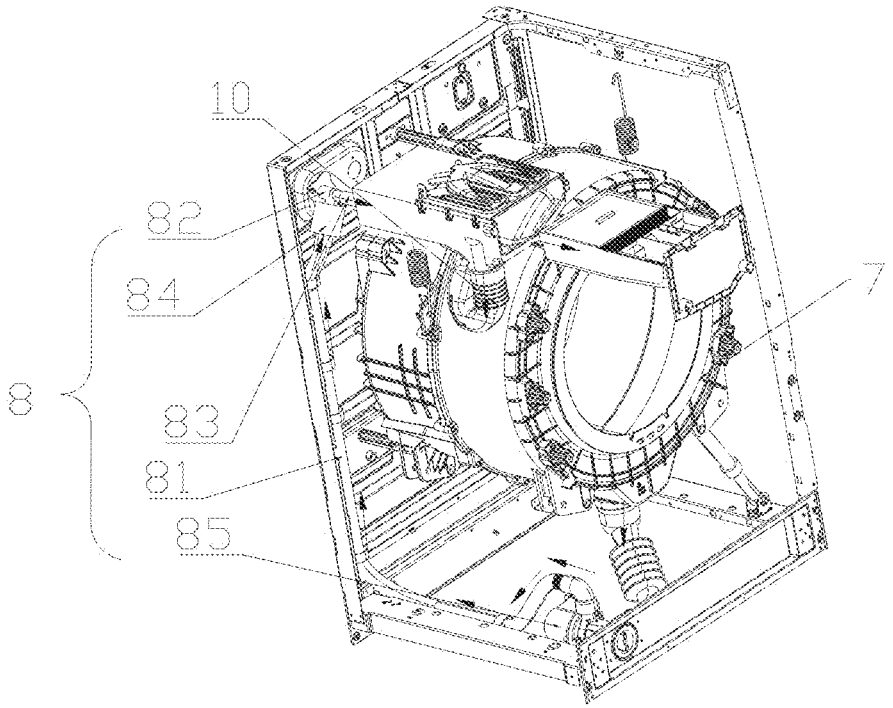
FIG. 7 is a schematic diagram of the structure of the washing apparatus of the present invention.
Figure 8:
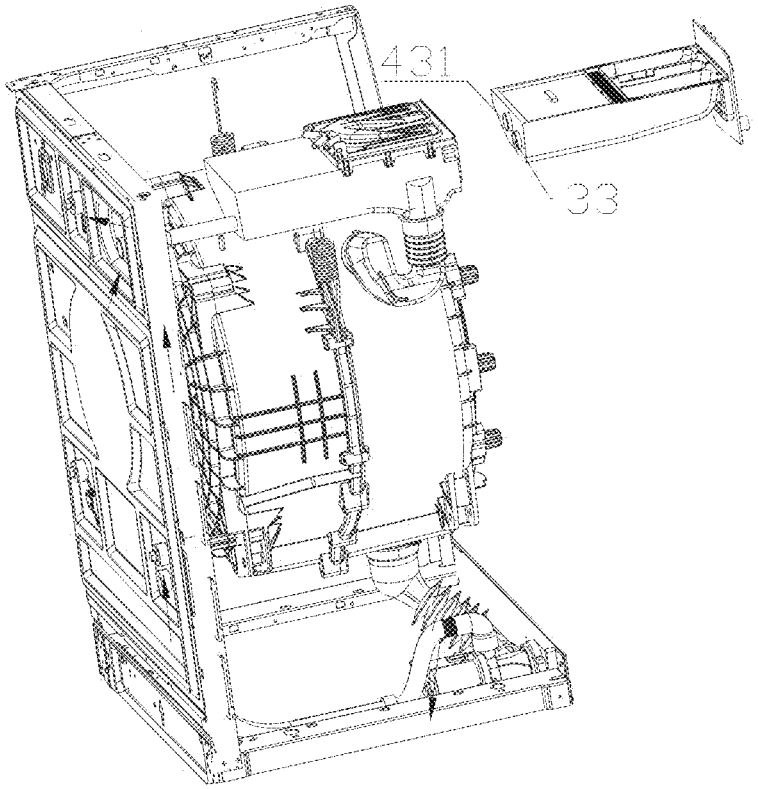
FIG. 8 is a schematic view of another angle of FIG. 7.

As shown in FIGS. 7 and 8, a washing apparatus of the present invention having a filtered detergent dispensing assembly as described above, comprising an outer drum 7; a drainage assembly 8, connected to the outer drum 7 for draining water in the outer cassette 7 to the outside of the machine or into the filtered detergent dispensing assembly; an inlet pipe 10, connected to the cassette 11 and the outer drum 7 for passing liquid from the detergent dispensing assembly into the outer drum 7; a judgment module for determining whether the filtration module 3 is clogged or not at least on the basis of the detected water pressure; a control module for controlling the state of the drainage assembly 8 and the operating state of the filtration module 3 and self-cleaning module 4 at least on the basis of the washing program and the clogged condition of the filtration module 3 as determined by the judgment module.

The drainage assembly 8 comprises, a first drain pipe 81, connected to the outer drum 7 for draining water from the outer drum 7; a three-way valve 84, the inlet end of which is connected to the first drain pipe 81; a second drain pipe 82, connected to one outlet end of the three-way valve 84 for draining water from the first drain pipe 81 out of the machine body; a circulation water pipe 83, the inlet end of which is connected to the other outlet end of the three-way valve 84 and the outlet end removably connected with the first water inlet section 33, for passing the water in the first drain pipe 81 into the detergent dispensing assembly for filtering and circulating. The control module may control the opening and closing state of the three-way valve 84 as well as the working state of the filtration module 3 and the self-cleaning module 4 according to the washing program and the clogging state of the filtration module as judged by the judgment module.

The cassette 11 is fixedly mounted on the outer wall of the outer drum 7, and the outlet end of the circulating water pipe 83 is provided on the cassette 11, matching the position of the inlet end of the first inlet section 33, and matched with the first inlet connector of the first inlet section 33 for removable connection.

The washing apparatus further comprises a tap water inlet hose, connected to the cassette 11, removably connected to a second inlet connector 431 of the second inlet section 43. Alternatively, the tap water inlet hose comprises, a first inlet hose, removable connected to the second inlet connector 431 of the second inlet section 43; and a second inlet hose, removable connected to the inlet of the detergent chamber 2.

As an embodiment, the first drain pipe 81, second drain pipe 82, recirculation water pipe 83, and three-way valve 84 are provided on the same side of the washing apparatus, near the rear part of the washing apparatus.

The first drain pipe 81 is provided with a drainage pump 85.

Further, the first drain pipe 81 is also provided with a detection device for detecting the content of microfibers and/or debris in the washing water in the first drain pipe 81.

Working principle: as shown in FIGS. 7 and 8, when the judgment module comes to the point that the content of microfibers and/or debris in the detected first drain pipe 81 is higher than a set value, or the washing equipment executes a program for washing fabrics with a high content of microfibers, sends the judgment result to the control module, and the control module controls the three-way valve 84 to open the valve leading to the circulating water pipe 83, and filters the washing water by the detergent dispensing assembly and then leads to the outer drum 7 for recycling through the inlet pipe 10 for recycling. When the judgment module reaches the point where the detected content of microfibers and/or debris in the first drain pipe 81 is not higher than a set value, or the washing apparatus executes a program for washing fabrics with a low content of microfibers, and sends the judgment result to the control module, the control module controls the three-way valve 84 to open the valve leading to the second drain pipe 82, and directly discharges the washing water out of the machine body. When the judgment module to the pressure detected by the pressure detection device 6 is greater than a set value, the judgment result is sent to the control module, and the control module controls the opening of the tap water inlet pipe to pass water into the second water inlet section 43 to clean the filtration module 3.

The washing apparatus of the present invention can choose to control the water discharged from the outer drum 7 to be filtered through the detergent delivery assembly and then passed into the outer drum 7 according to the actual situation, so as to achieve the function of circulating the washing water as well as preventing the microfibers from eventually entering into the soil and causing harm to the environment; or choose to discharge directly, so as to make full use of the function of the detergent assembly's water intake, and to reduce the space occupied by the filtration module 3 and the self-cleaning module 4.

The above is only a preferred embodiment of the present invention, and is not a formal limitation of the present invention. Although the present invention has been disclosed in a preferred embodiment as above, it is not intended to limit the present invention, and any skilled person familiar with the present patent may, without departing from the scope of the technical scheme of the present invention, use the technical contents of the above mentioned hints to make some changes or modifications for equivalent changes in equivalent embodiments, and the embodiments of the above mentioned embodiments may also be further combined or replaced. The embodiments of the above mentioned embodiments may be further combined or replaced, but any simple modifications, equivalent changes and modifications made to the above embodiments according to the technical substance of the present invention without departing from the content of the technical scheme of the present invention still fall within the scope of the present invention.

The invention claimed is:

1. A filtered detergent dispensing assembly comprising a drawer and a cassette for containing the drawer, wherein the drawer comprises, detergent chamber for holding detergent;

a filtration module, provided on the drawer for filtering debris;

a self-cleaning module, connected to the filtration module, for cleaning the filtration module;

the filtration module comprises, a housing, provided in the drawer, forming a chamber inside;

a filtration section, provided within the housing;

a first water inlet section, provided on the housing;

a first water outlet section, provided on the housing, with an inlet end located on a different side of the filtration section from an outlet end of the first water inlet section;

a first valve body, provided on the first water outlet section, for controlling a passage of water in the first water outlet section;

the self-cleaning module comprises, a second water inlet section, provided on the housing for passing tap water into the chamber from an orientation different from that in which water to be filtered passes through the filtration section;

a second water outlet section, provided on the housing, with an inlet end located on a different side of the filtration section from an outlet end of the second water inlet section, connected to the outlet end of the first water inlet section for discharging tap water from a side of the filtration section where the water to be filtered and into a stowage section;

the stowage section, located downstream of the filtration section, is used to collect debris removed from the filtration module carried by discharged tap water;

a second valve body, provided on the second water outlet section, for controlling on and off of a water path of the second water outlet section;

a scraping section, disposed inside the housing, subjected to forceful movement for scraping debris from at least the filtration section.

2. The filtered detergent dispensing assembly according to claim 1, wherein the filtration section is a hollow columnar structure with through holes in an outer wall, and the scraping section is provided in an inner cavity formed by the filtration section, in contact with an inner wall of the filtration section.

3. The filtered detergent dispensing assembly according to claim 2, wherein a gap is provided between at least one side of a peripheral wall of the filtration section and/or an end of the filtration section away from the first water inlet section and an inner wall of the housing, and an outlet end of the second water outlet section is provided in the gap.

4. The filtered detergent dispensing assembly according to claim 1, wherein the filtration section comprises, a filtration body for filtering debris;

a limiting unit, having a perforated structure, is provided on the filtration body for hindering a deformation of the filtration body under force.

5. The filtered detergent dispensing assembly according to claim 1, wherein the housing is further provided with a pressure sensor, provided adjacent to the filtration section, for detecting water pressure.

6. A washing apparatus wherein a filtered detergent dispensing assembly as described in claim 1 is installed.

7. The washing apparatus according to claim 6, wherein it comprises, an outer drum;

a drainage assembly, in communication with the outer drum, for draining water from the outer drum to an exterior of the washing apparatus or into the filtered detergent dispensing assembly;

an inlet pipe, connecting the cassette to the outer drum, for passing liquid from the detergent dispensing assembly into the outer drum;

a processor configured to determine, at least based on a detected water pressure, whether the filtration module is clogged;

a controller for controlling a state of the drainage assembly and an operating state of the filtration module and self-cleaning module, at least in accordance with a washing program and a clogging condition of the filtration module as determined by the processor.

8. The filtered detergent dispensing assembly according to claim 1, wherein an inlet end of a second water inlet section and an inlet end of the first water inlet section are located on the same side of the housing;

the inlet end of the second water outlet section and the outlet end of the first water inlet section are located on the same side of the housing.

9. The filtered detergent dispensing assembly according to claim 2, wherein an opening is provided at one end of the filtration section towards the first water inlet section for passing water to be filtered through the opening into the inner cavity.

10. The filtered detergent dispensing assembly according to claim 2, wherein the scraping section is provided in a plurality; the scraping section is a mesh plate-shaped structure, with two ends of the scraping section movably resisting the inner wall of the filtration section.

11. The filtered detergent dispensing assembly according to claim 3, wherein the outlet end of the second water outlet section is provided on a side adjacent to an inlet side of the water to be filtered in the filtration section.

12. The filtered detergent dispensing assembly according to claim 4, wherein a limiting unit comprises, a first fixing frame, provided on a side of a filtration body facing a first inlet section, may be fixedly connected to an inner wall of the housing and the filtration section;

a second fixing frame, provided on a side of the filtration body away from the first fixing frame, the scraping section being fixedly connected to the second fixing frame.

13. The filtered detergent dispensing assembly according to claim 2, wherein the filtration section comprises, a filtration body for filtering debris;

a limiting unit, having a perforated structure, is provided on the filtration body for hindering a deformation of the filtration body under force.

14. The washing apparatus according to claim 7, wherein the drainage assembly comprises, a first drain pipe, connected to the outer drum, for discharging water from the outer drum to outside;

a three-way valve, an inlet end of which is connected to the first drain pipe;

a second drain pipe, connected to one outlet end of the three-way valve, is used to discharge water from the first drain pipe out of the washing apparatus;

a circulation water pipe, an inlet end connected to an other outlet end of the three-way valve, and an outlet end removably connected to the first inlet section for filtering and recirculating water from the first drain pipe into the detergent dispensing assembly;

the controller controls an opening and closing state of the three-way valve.

15. A filtered detergent dispensing assembly comprising a drawer and a cassette for containing the drawer, wherein the drawer comprises, detergent chamber for holding detergent;

a filtration module, provided on the drawer for filtering debris;

a self-cleaning module, connected to the filtration module, for cleaning the filtration module;

the filtration module comprises, a housing, provided in the drawer, forming a chamber inside;

a filtration section, provided within the housing;

a first water inlet section, provided on the housing;

a first water outlet section, provided on the housing, with an inlet end located on a different side of the filtration section from an outlet end of the first water inlet section;

a first valve body, provided on the first water outlet section, for controlling a passage of water in the first water outlet section;

the self-cleaning module comprises, a second water inlet section, provided on the housing for passing tap water into the chamber from an orientation different from that in which water to be filtered passes through the filtration section;

a second water outlet section, provided on the housing, with an inlet end located on a different side of a filtration section from an outlet end of the second water inlet section, connected to the outlet end of the first water inlet section for discharging tap water from a side of the filtration section where the water to be filtered and into a stowage section;

the stowage section, located downstream of the filtration section, is used to collect debris removed from the filtration module carried by discharged tap water;

a second valve body, provided on the second water outlet section, for controlling on and off of a water path of the second water outlet section;

a scraping section, disposed inside the housing, subjected to forceful movement for scraping debris from at least the filtration section;

wherein the filtration section is a hollow columnar structure with through holes in an outer wall, and the scraping section is provided in an inner cavity formed by the filtration section, in contact with an inner wall of the filtration section;

wherein a gap is provided between at least one side of a peripheral wall of the filtration section and/or an end of the filtration section away from the first water inlet section and the inner wall of the housing, and an outlet end of the second water outlet section is provided in the gap.

16. The filtered detergent dispensing assembly according to claim 15, wherein the outlet end of the second water outlet section is provided on a side adjacent to an inlet side of the water to be filtered in the filtration section.

* * * * *